US006688917B2

(12) United States Patent
Ushio et al.

(10) Patent No.: US 6,688,917 B2
(45) Date of Patent: Feb. 10, 2004

(54) POWER OUTPUT CONTROL APPARATUS

(75) Inventors: Hiroki Ushio, Tokyo (JP); Fumihiro Minami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,216

(22) Filed: Oct. 29, 2002

(65) Prior Publication Data

US 2003/0082953 A1 May 1, 2003

(30) Foreign Application Priority Data

Oct. 30, 2001 (JP) ..... P2001-332257

(51) Int. Cl.[7] ..... H01R 25/00
(52) U.S. Cl. ..... 439/638

(58) Field of Search ..... 439/540.1, 637, 439/717, 638, 70, 71, 59

(56) References Cited

U.S. PATENT DOCUMENTS 6,039,582 A * 3/2000 Geis et al. ..... 439/76.1

FOREIGN PATENT DOCUMENTS

JP 11-329761 11/1999

* cited by examiner

*Primary Examiner*—Son V. Nguyen
(74) *Attorney, Agent, or Firm*—Birch, Stewart, Kolasch & Birch, LLP

(57) ABSTRACT

An integral connector in which a power input connector and a power output connector are integrated with each other is disposed on a base plate.

10 Claims, 6 Drawing Sheets

POWER OUTPUT CONTROL APPARATUS

BACKGROUND OF THE INVENTION

1. Field of the Invention

The present invention relates to a connector, which is used in various apparatuses such as a lighting control apparatus for a high intensity discharge lamp (HID) of an automobile.

2. Description of the Related Art

A unit of a discharge lamp apparatus has been known, which has a power input connector and an output connector connected to an ignitor as shown in FIG. 10. In such a discharge lamp apparatus according to the related art, the connectors are attached to the apparatus in different working steps and in different directions, respectively and hence the connectors are configured as separate parts.

In the above-mentioned connector, since the power input connector and the output connector are configured as separate parts, it is necessary to form screw bosses for fixation on a case and screw holes for fixation in a base plate. Therefore, space for fixing the connector, number of parts, and number of working steps cannot be reduced.

The power input connector and the output connector are placed in different positions, and separate openings are correspondingly formed in the case. Therefore, the structure is complicated.

SUMMARY OF THE INVENTION

It is an object of the invention to provide a connector in which a power input connector and an output connector can be integrated with each other, the installation space and the like can be reduced, and the configuration is simplified.

According to the invention, a power output control apparatus has a power input connector and a power output connector. An integral connector in which the power input connector and the power output connector are integrated with each other is disposed on a base plate.

DETAILED DESCRIPTION OF THE PREFERRED EMBODIMENTS

Embodiment 1

Figure 1:
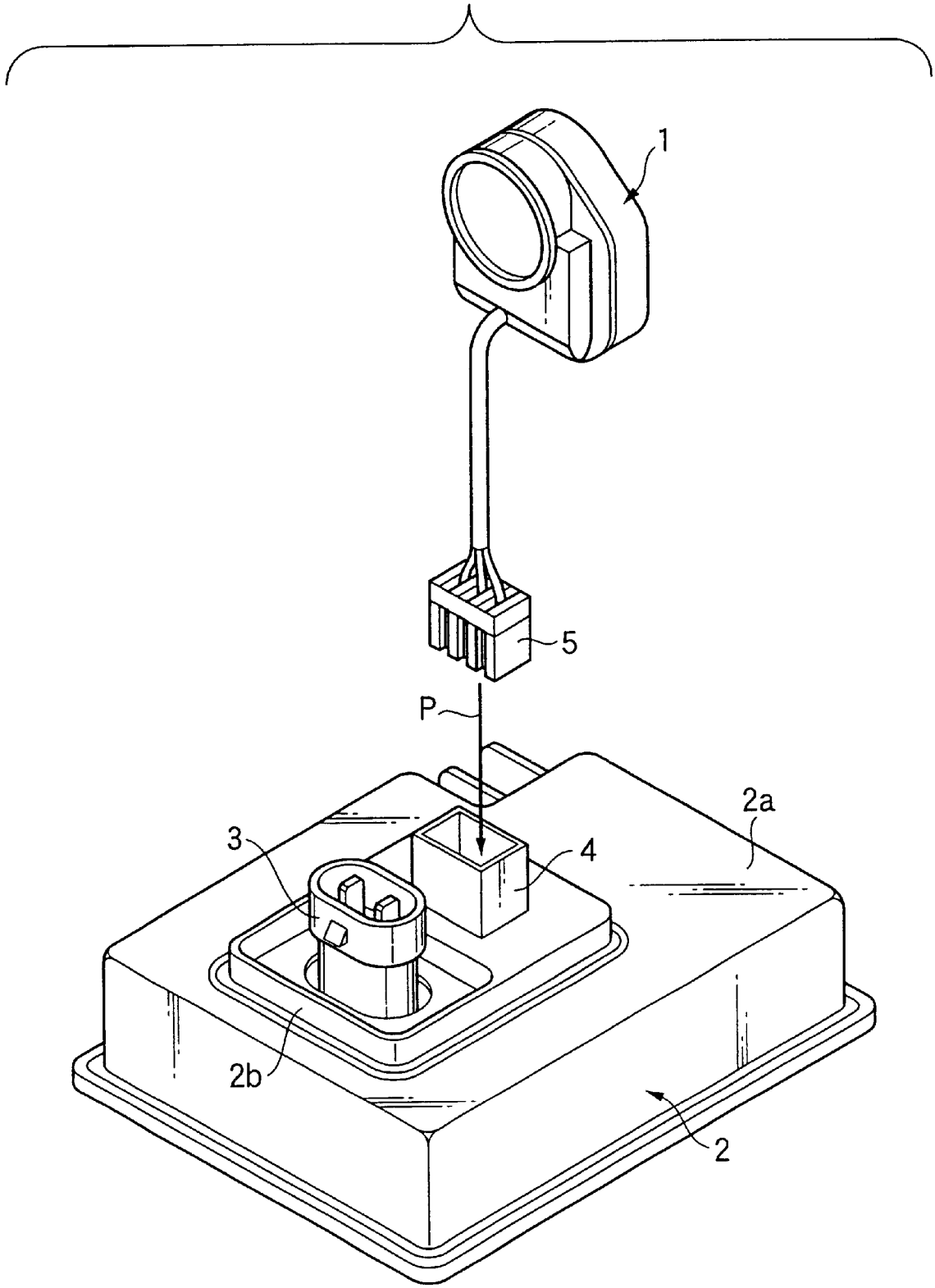
FIG. 1 is a perspective view of a lighting control apparatus for a discharge lamp according to Embodiment 1 of the invention.

FIG. 1 is a perspective view showing a lighting control apparatus for a discharge lamp (HID) according to Embodiment 1.

The apparatus is configured by a combination of an ignitor 1 having a high-voltage generator and a unit 2 into which a circuit for controlling a high-voltage generating circuit and a booster circuit that boosts the power source voltage to a rated voltage of the discharge lamp are incorporated.

A connector of the embodiment is placed on the side of the unit, and a connecting portion of the connector protrudes to the outside of the unit.

The connector includes a power input connector 3 to which a power source line from a vehicle-mounted battery is to be connected and a power output connector 4 to which a high-voltage wire to the ignitor is to be connected. A connector 5 of the ignitor is inserted into the power output connector 4 in a direction indicated by an arrow P.

Reference numeral 2*a* denotes a metal case of the unit 2, and 2*b* denotes a plate which functions as a part of the case of the unit 2 and surrounds the power input connector 3 and the power output connector 4 to protect them.

Figure 2:
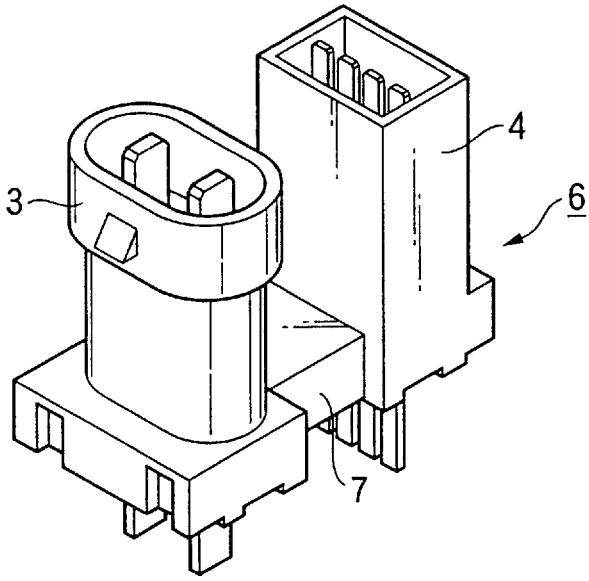
FIG. 2 is a perspective view of an integral connector.

FIG. 2 is a perspective view of an integral connector 6 in which the power input connector 3 and the power output connector 4 are integrally molded.

The integral connector 6 is held at a connector coupling portion 7 by a base plate with a metal part which will be described later.

In this way, the connectors are integrated with each other, and the coupling portion 7 is disposed between the connectors, whereby the rigidity of the connector attachment is improved.

Figure 3:
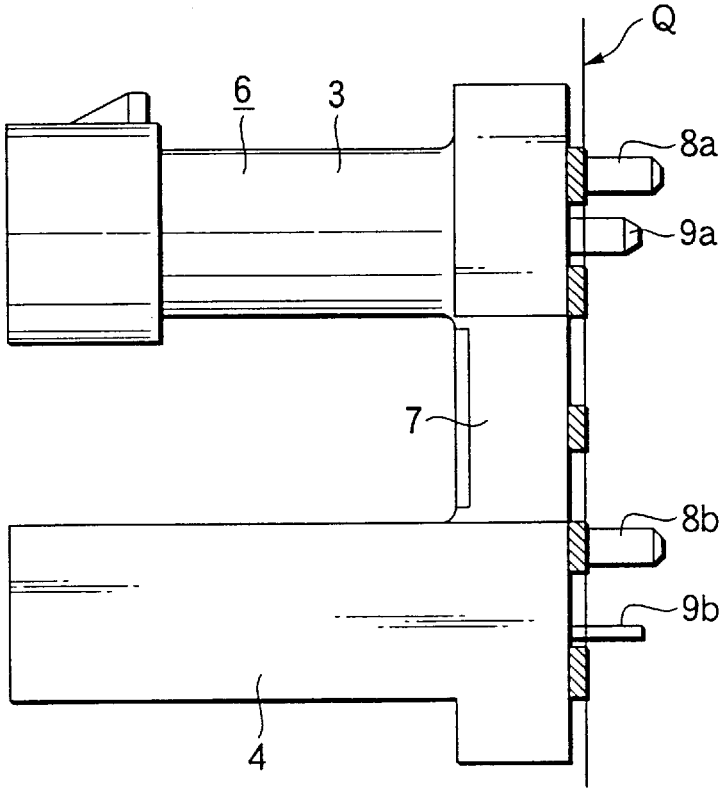
FIG. 3 is a side view of the integral connector.
Figure 4:
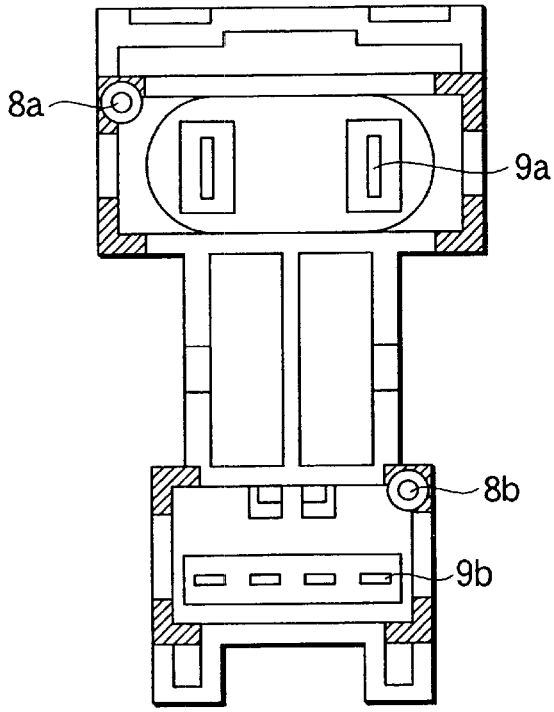
FIG. 4 is a bottom view of the integral connector.

FIG. 3 is a side view of the integral connector, and FIG. 4 is a bottom view of the integral connector. The figures particularly show a base plate contacting portion (hatched areas) and positioning pins.

A line Q in FIG. 3 indicates a plane contacting with the base plate. In FIGS. 3 and 4, the hatched places indicate portions contacting with the base plate. Reference numerals 8*a* and 8*b* denote positioning pins which are passed through holes of the base plate to position the integral connector 6 on the base plate.

The base plate contacting portion is not configured in the whole face of the integral connector 6, but by partly forming the bottom face into a convex shape, whereby the portion can be prevented from being in contact with a pattern, so that the reliability is improved.

At least four holes for positioning and locking to the base plate are required in total for the power input connector and the output connector (at least two holes for each of the connectors). By contrast, the number of the holes can be reduced to two by the integration, and the effective area of the base plate can be increased.

The pins can be placed in arbitrary positions of the connector on the side where the connector is in contact with the base plate (from the viewpoint of strength, it is preferable to symmetrically arrange the pins).

Reference numeral 9*a* denotes connecting pins of the power input connector with respect to the base plate, and 9*b* denotes connecting pins of the output connector with respect to the base plate.

Figure 5:
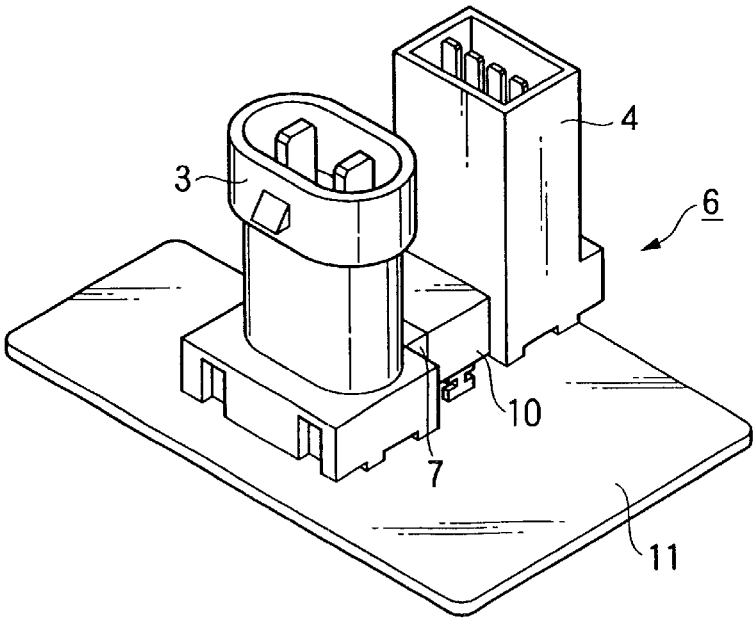
FIG. 5 is a perspective view showing attachment of the integral connector to a base plate.
Figure 6:
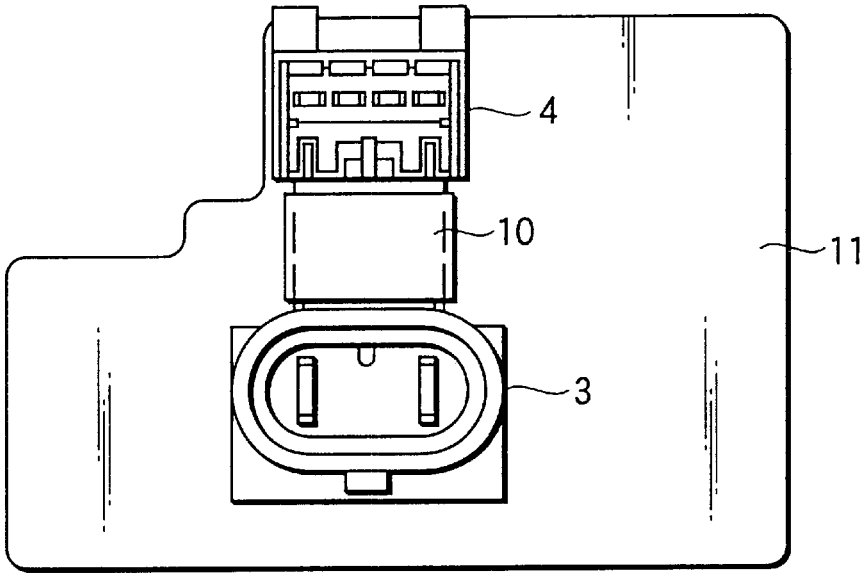
FIG. 6 is a plan view showing attachment of the integral connector to the base plate.

FIGS. 5 and 6 illustrate attachment of the integral connector 6 to the base plate 11. FIG. 5 is a perspective view, and FIG. 6 is a plan view.

Referring to the figures, a space for fixing to the base plate 11 is formed in the coupling portion 7 between the power input connector 3 and the output connector 4, and the integral connector is fixed by a holder 10.

Since the space for placing the holder 10 is formed, it is not required to separately fix the power input connector 3 and the output connector 4 to the base plate 11, and hence the workability is improved.

Figure 7:
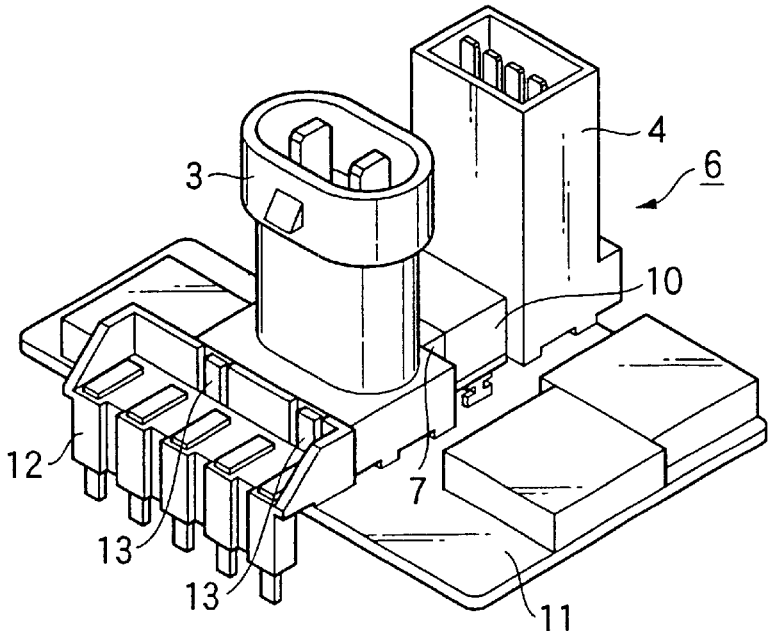
FIG. 7 is a perspective view showing another member and the integral connector.
Figure 8:
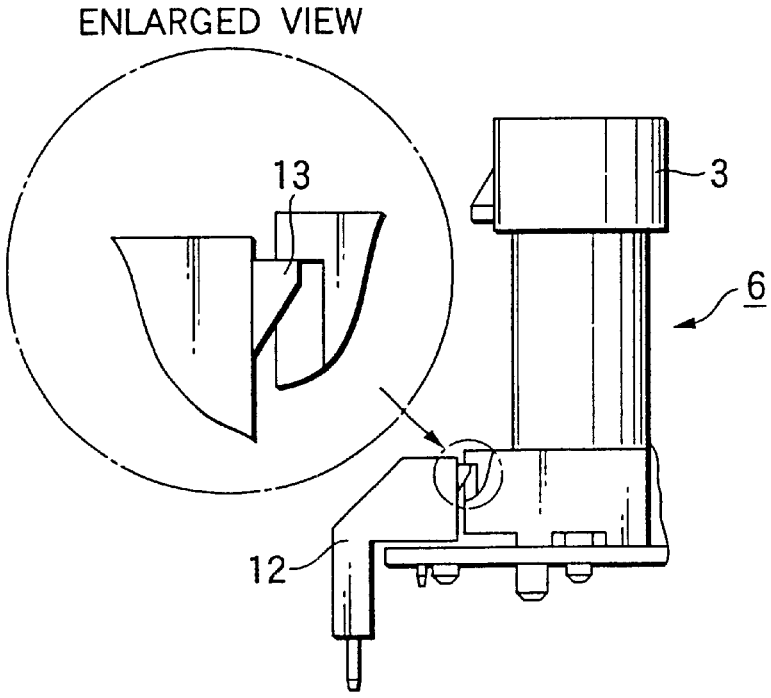
FIG. 8 is a side view showing the other member and the integral connector.

FIGS. 7 and 8 show a state where another part on the base plate is positioned and fixed to the integral connector 6 in a snap-fitting manner. FIG. 7 is a perspective view, and FIG. 8 is a side view.

In this way, an adjacent part (in this example, a member which is placed below the base plate 11 and used for connection with the base/plate) is fixed to the integral connector 6 by using a snap-fitting portion 13, thereby enabling positioning and fixing on the base plate 11 to be surely conducted.

Figure 9:
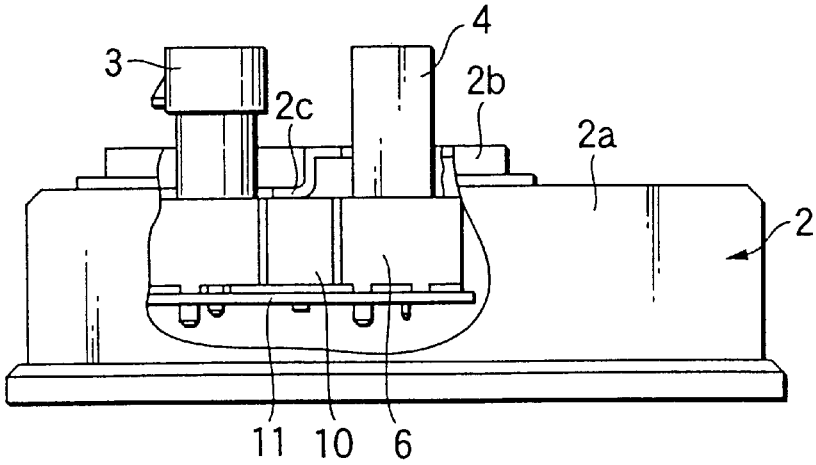
FIG. 9 is a fragmentary section view showing the integral connector and a case.
Figure 10:
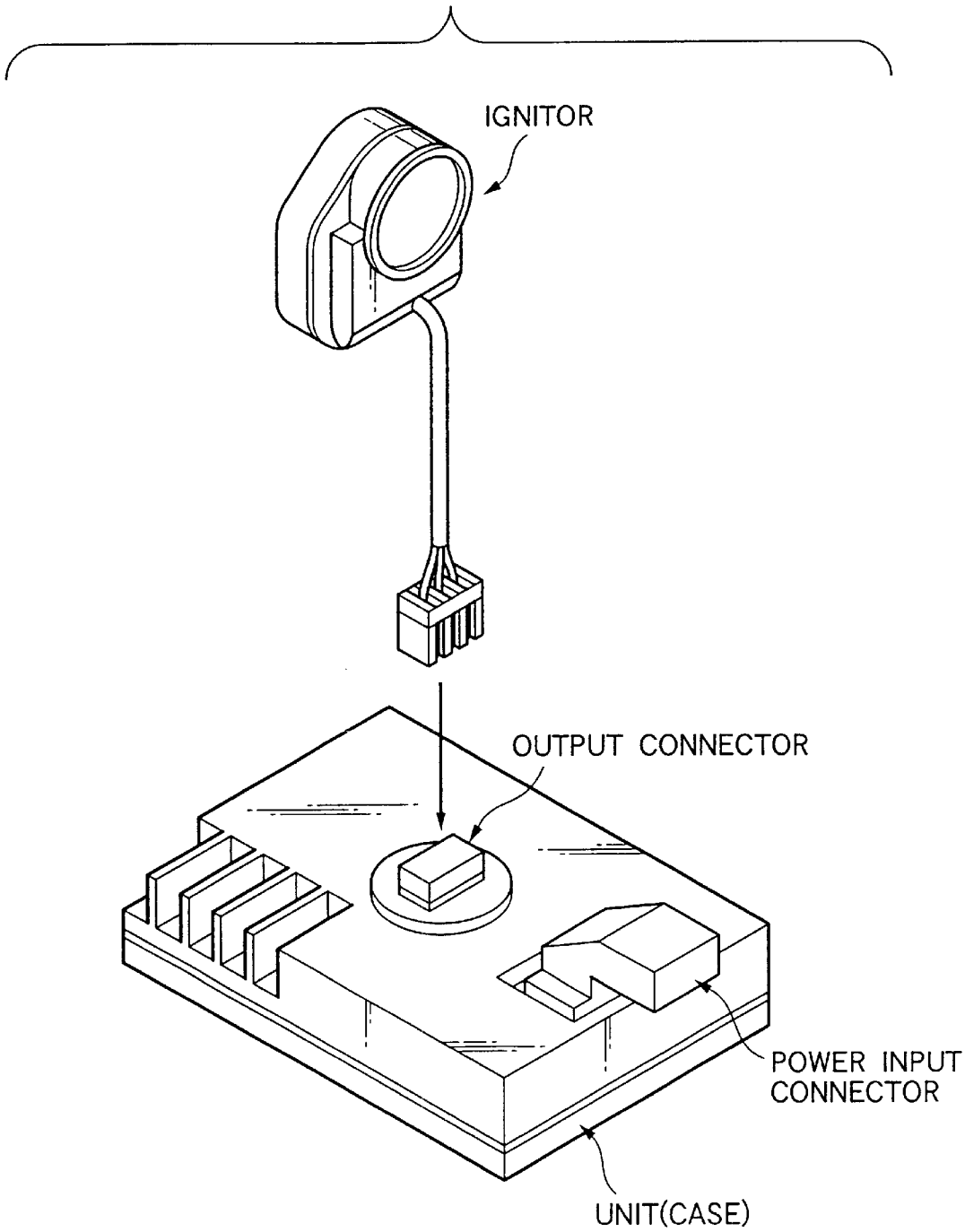
FIG. 10 is a perspective diagram showing a unit of a discharge lamp apparatus according to the related art.

FIG. 9 is a fragmentary section view showing an example having a configuration in which the integral connector 6 is in contact with the inner peripheral face of the case 2*a*.

Referring to the figure, since the integral connector 6 is in contact with the case 2*a* (in the figure, the holder 10 is in contact with a part 2*c* of the plate 2*b*), no stress is applied to the base plate by a pulling force exerted in release of the connection of the connector or by an external force, and hence the reliability is improved.

In place of the configuration in which the holder 10 butts against the part 2*c* of the plate 2*b*, a configuration in which the integral connector 6 directly butts against the plate 2*b* or the case 2*a* may be employed.

The above-described embodiment has the following further features.

Since the embodiment is structured so that the power input connector is integrated with the output connector to which the ignitor is to be connected, a structure in which the rigidity is improved and which can stand without support during a work of incorporating the base plate is obtained. Therefore, the time period of the incorporating work can be shortened.

Although at least two holes (four holes in total) for positioning and locking the connector to the base plate are required for each of the power input connector and the output connector, the number of the holes can be reduced to two by the integration, thereby enabling the effective area of the base plate to be increased.

Since the portion of installing the metal part for fixing the connector is disposed between the connectors, the work of fixing the power input connector and the output connector can be conducted in one place, and hence the workability is improved.

Since the connector is formed as an integral one, a space for fixing the connector to the base plate can be disposed, and the power input connector and the output connector can be simultaneously fixed by a sheet metal holder or the like.

Since the positioning shape in which another part on the base plate is snap-fittingly fixed is disposed, a shape in which the rigidity is improved by forming the connector as an integral one can be realized. Therefore, it is possible to dispose a positioning structure which can surely fix another adjacent part on the base plate. This contributes to a reduced space.

The space of the connecting portion of the power input connector and the power output connector which can be placed by disposing a portion which is in contact with the case in the contacting portion and forming the connector as an integral one is in contact with the case of the unit. According to the configuration, the case can receive the pulling force exerted in cancellation of the connection of the connector.

Therefore, no stress is applied to the base plate by the pulling force exerted in cancellation of the connection of the connector or by an external force, and hence the reliability is improved.

In the power output control apparatus of the invention, the integral connector in which the power input connector and the power output connector are integrated with each other is disposed on a base plate. Therefore, the width of the connector can be increased, the connector can be surely fixed to the base plate even when attaching places are reduced in number or in area, the mounting area can be reduced so that the base plate can be effectively used, and the mounting work can be simplified.

Since the fixing member for fixing the integral connector to the base plate is disposed between the power input connector and the power output connector, the connector can be fixed to the base plate more surely at a reduced number of fixing places.

Since a snap-fitting portion which can snap-fittingly fix another member placed on the base plate is disposed, the other member can be simply fixed and positioned by using the integral connector.

Furthermore a case having a hole through which the power input connector and the power output connector protrude is disposed, the case surrounding the base plate, and a contact member which butts against and fixes the integral connector is disposed on an inner face of the case. When the integral connector is housed in the case, therefore, the integral connector can be fixed more surely by the case, whereby a failure such as that caused by a work of connection to the connector after the connector is housed in the case can be prevented from occurring.

Since the power input connector is connected to a vehicle battery, the power output connector is connected to a ignitor for a vehicle discharge lamp, and a voltage input through the power input connector is boosted to be output to the ignitor through the power output connector, the power output control apparatus can be used in a vehicle discharge lamp apparatus.

What is claimed is:

1. A power output control apparatus comprising:

a power input connector;

a power output connector;

an integral connector in which the power input connector and the power output connector are integrated with each other is disposed on a base plate; and a coupling portion disposed between the power input connector and the power output connector such that the integral connector is fixed to the base plate using the coupling portion.

2. The power output control apparatus according to claim 1, wherein a fixing member to engage the coupling portion for fixing the integral connector to the base plate is disposed between the power input connector and the power output connector.

3. The power output control apparatus according to claim 1, wherein a snap-fitting portion, which can snap-fittingly fix another member placed in the base plate, is disposed.

4. The power output control apparatus according to claim 1, wherein the power input connector is connected to a vehicle battery;

wherein the power output connector is connected to a ignitor for a vehicle discharge lamp; and wherein a voltage inputted through the power input connector is boosted and outputted to the ignitor through the power output connector.

5. A power output control apparatus comprising:

a power input connector;

a power output connector;

wherein an integral connector in which the power input connector and the power output connector are integrated with each other is disposed on a base plate;

wherein a case having a hole through which the power input connector and the power output connector protrude is disposed;

wherein the case surrounds the base plate; and wherein a contact member, which butts against and fixes the integral connector, is disposed on an inner face of the case.

6. A power output control apparatus comprising:

an integral connector to integrally mold a power input connector and a power output connector, the integral connector attached to a base plate;

a case surrounding the base plate having a hole, wherein the power input connector and the power output connector protrude through the hole; and a contact member disposed on an inner face of the case to fix the integral connector to the base plate.

7. The power output control apparatus according to claim 6, further comprising a holder to fix the integral connector to the base plate.

8. The power output control apparatus according to claim 7, wherein a coupling portion disposed between the power input connector and the power output connector engages the holder to fix the integral connector to the base plate.

9. A method for manufacturing a power output control apparatus, comprising:

integrally molding a power input connector and a power output connector with an integral connector;

disposing the integral connector on a base plate; and fixing the integral connector to the base plate by engaging a coupling portion between the power input connector and the power output connector with a holder.

10. The method according to claim 9, further comprising surrounding the base plate with a case, the case having a hole to allow the power input connector and the power output connector to protrude through.

* * * * *